United States Patent [19]

Oliver et al.

[11] Patent Number: 4,688,409

[45] Date of Patent: Aug. 25, 1987

[54] DROP-BOLT DOOR LOCK ASSEMBLY

[75] Inventors: Ronald N. Oliver, Salem; Stevie C. Roop, Dugspur, both of Va.

[73] Assignee: Medeco Security Locks, Inc., Salem, Va.

[21] Appl. No.: 873,256

[22] Filed: Jun. 6, 1986

Related U.S. Application Data

[63] Continuation of Ser. No. 637,588, Aug. 3, 1984, abandoned.

[51] Int. Cl.[4] ..... E05B 9/08; E05B 63/00

[52] U.S. Cl. ..... 70/417; 70/451; 70/452

[58] Field of Search ..... 70/417, 451, 452; 292/357

[56] References Cited

U.S. PATENT DOCUMENTS

| | | | |
|---|---|---|---|
| 1,065,848 | 6/1913 | Segal . | |
| 1,922,043 | 8/1933 | Hines | 292/138 |
| 3,095,727 | 7/1963 | Kerr | 70/451 |
| 3,545,799 | 12/1970 | Gertsfeld | 292/34 |
| 3,582,119 | 6/1971 | Woodworth | 292/27 |
| 3,698,217 | 10/1972 | Roy | 70/451 |
| 3,768,284 | 10/1973 | Kent et al. | 70/417 X |
| 3,981,168 | 9/1976 | Coralli et al. | 70/417 |
| 4,296,619 | 10/1981 | Widen | 70/452 X |
| 4,316,371 | 2/1982 | Del Nero | 70/452 X |
| 4,466,264 | 8/1984 | Del Nero | 70/417 |
| 4,484,463 | 11/1984 | Hennessey | 70/452 |
| 4,522,048 | 6/1985 | Davis | 70/452 X |
| 4,530,223 | 7/1985 | Oliver | 70/417 |

FOREIGN PATENT DOCUMENTS

| | | | |
|---|---|---|---|
| 996552 | 6/1965 | United Kingdom | 292/357 |
| 1190930 | 5/1970 | United Kingdom | 70/452 |

OTHER PUBLICATIONS

New England Lock & Hardware Co.—Advertisement.
R. Wasson, Locksmith Ledger, Jun. 1983, pp. 17–19.
Locksmith Ledger, Jul. 1983, p. 19—Advertisement.

*Primary Examiner*—Robert L. Wolfe
*Attorney, Agent, or Firm*—Bernard, Rothwell & Brown

[57] ABSTRACT

A high security drop-bolt lock assembly for a door includes a cylinder lock carried by a guard plate positionable on the outside of the door with the cylinder lock within the door, and a drop-bolt assembly on the inside of the door. The drop-bolt assembly is connected to protected studs extending from the guard plate to make a strong unitary construction extremely difficult to defeat and protecting the cylinder lock behind the guard plate and within the door.

3 Claims, 3 Drawing Figures

DROP-BOLT DOOR LOCK ASSEMBLY

This is a continuation of application Ser. No. 637,588, filed Aug. 3, 1984, now abandoned.

BACKGROUND OF THE INVENTION

1. Field of the Invention

This invention relates to improvements in drop-bolt-type lock assemblies, and particularly to such an assembly operated from a protected high security lock cylinder.

2. Prior Art

It is known in the art that drop-bolt locks provide extremely good resistance to defeat by jimmying, chiseling, prying and the like.

However, even if a drop-bolt lock is highly resistant to defeat, it can be compromised if the cylinder which operates the lock bolt can be defeated.

It is also known in the art to protect lock cylinders by guard plates or the like. Nevertheless, there remains a need in the art to provide a drop-bolt lock and cylinder assembly which is highly resistant to defeat by jimmying, chiseling and prying.

SUMMARY OF THE INVENTION

This invention provides a drop-bolt lock assembly for a door in which the drop-bolt assembly is on one side of the door, e.g., the inside, and an operating lock cylinder is accessed from the outside of the door. The lock cylinder is protected by a heavy guard plate and the body of the cylinder lock is within the body of the door, while the drop-bolt is on the inside surface of the door. Thus, the cylinder lock is sandwiched between an outside guard plate and the inside drop-bolt operating housing. The guard plate and drop-bolt operating housing are interconnected so as to provide an extremely rugged and strong defeat-proof lock bolt assembly.

DETAILED DESCRIPTION OF THE PREFERRED EMBODIMENT

Figure 1:
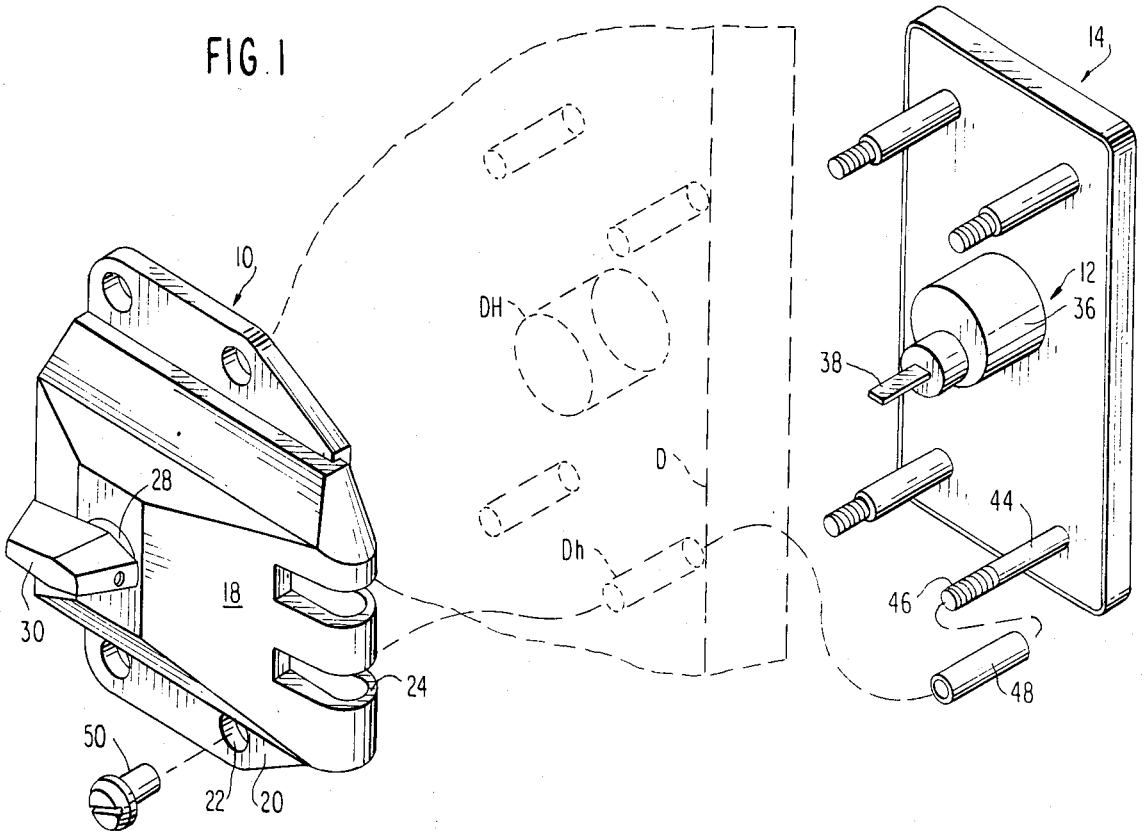
FIG. 1 is a perspective view illustrating the protected drop-bolt lock assembly of this invention.
Figure 3:
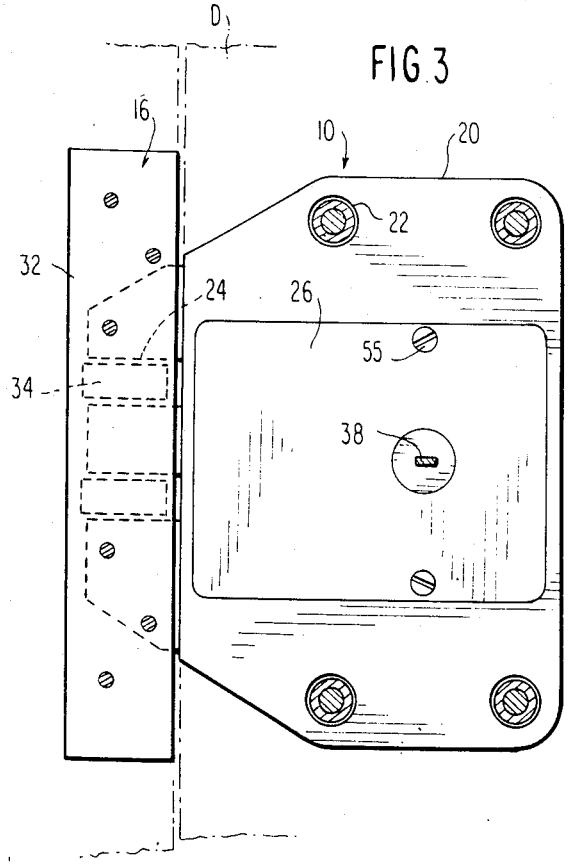
FIG. 3 is an elevation view taken along line 3—3 of FIG. 2 and also illustrating the door jam and keeper for the drop-bolt.

The principal components of the invention as shown in FIG. 1 include a drop-bolt assembly 10, a cylinder lock assembly 12, a guard plate assembly 14 and a keeper or strike 16, see FIG. 3. The drop-bolt assembly 10 is mounted flush on one side of a door D. The door D has small holes Dh drilled therethrough on a pattern around a large hole DH for a cylinder lock. The cylinder lock assembly 12 extends into the large hole DH of the door D and the guard plate assembly 14 mounts flush to the outside of the door as illustrated in the drawings. The keeper 16 is mounted on the inside of the door to cooperate with the drop-bolt assembly 10 as is known in the art.

The drop-bolt assembly 10 includes a housing 18 having mounted flanges 20 extending from the top and bottom sides thereof. These mounting flanges have a plurality of holes positioned to mate with the position of the holes Dh in the door D. The edge of the drop-bolt assembly adjacent the keeper 16 has spaces 24 for mating with the keeper, the drop-bolt extending vertically through the spaces 24 as is known in the art.

The drop-bolt housing 18 incorporates mechanisms which operate the drop-bolt. Such mechanisms are the subject of another application assigned to Medeco Security Locks, Inc., Ser. No. 637,589 filed Aug. 3, 1984 and now abandoned. The mechanisms in the housing are covered by a plate 26 which provides access from the rear side of the housing, see FIG. 3.

The cylinder lock assembly 12 includes a cylinder lock 36 preferably of the high security type manufactured by Medeco Security Locks, Inc. of Salem, Va., and disclosed in U.S. Pat. No. 3,499,302. The lock has an operating tang 38 which extends through plate 26 and into the mechanism within the drop-bolt housing 18 for operating the drop-bolt from the lock cylinder.

The keeper or strike 16 is formed of a keeper mounting plate 32 and integral keeper rings 34 which extend into the spaces 24 to provide the holding function when the vertical drop-bolt is extended. The keeper mounting plate may be flat to fit flush or angled to fit a corner.

The guard plate assembly 14 is preferably formed with a thick protective plate 40 and a decorative cover plate 42. The guard plate assembly mounts the cylinder lock 36 as is known, and preferably as in the commercial guard plate sold by Medeco Security Locks, Inc. under the trademark BODYGUARD and as disclosed in application Ser. No. 438,373 filed Nov. 1, 1982 now U.S. Pat. No. 4,530,223 and assigned to Medeco Security Locks, Inc. As disclosed in this patent application, a plurality of studs 44 are integral with the protective plate 40 and extend rearwardly therefrom. These studs 44 extend through the holes Dh in the door D and have threaded portions 46 at their ends. Hardened stud-protecting sleeves 48 are slipped over each of the studs 44 as shown in FIG. 1 to prevent sawing or otherwise cutting of the studs in an attempt to defeat the lock.

Figure 2:
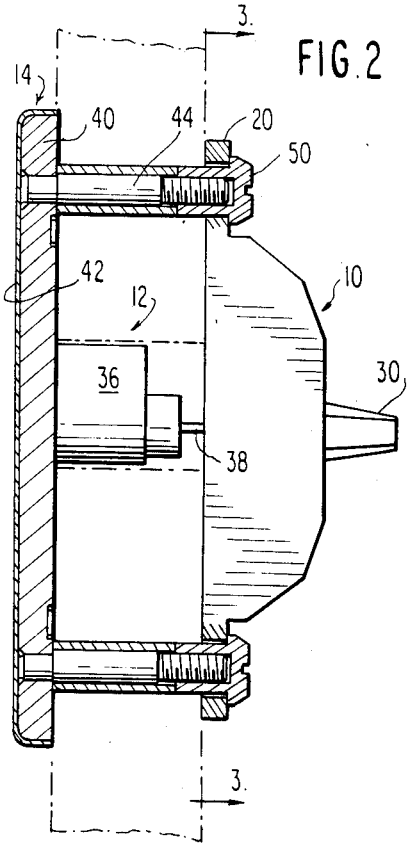
FIG. 2 is a side elevational view with portions shown in section for the sake of clarity.

The threaded ends 46 of the studs 44 cooperate with internal threads in housing mounting nuts 50 which extend through holes 22 in the mounting flanges 20 of housing 18, see FIGS. 1 and 2.

In installation, the door D is drilled with a template to provide the holes Dh and DH, the guard plate assembly 14 with the cylinder lock assembly 12 therein is placed against the door so that the cylinder lock assembly 12 extends within the door and the tang 38 extends through the door for cooperating with the drop-bolt assembly 10. The drop-bolt assembly 10 is mounted flush on the inside surface of the door and is connected via mounting nuts 50 to the ends of the sleeve-protected studs 44. A proper key (not shown) in cylinder lock 36 will operate tang 38 to cause the drop-bolt to either extend through or be retracted from a vertical path extending through spaces 24 and rings 34 of the keeper 16. If desired, the drop-bolt can also be operated from the inside of the door via thumb key 30 and lock cylinder 28.

As a variation, the drop-bolt can be operated with a single cylinder, namely, cylinder 36 rather than the double cylinder arrangement shown.

The arrangement provides an extremely strong, defeat-resistant lock bolt assembly not available with the known prior art constructions.

We claim:

1. A high security defeat-resistant, drop-bolt lock assembly for a door, the lock assembly comprising:

(a) a cylinder lock having an operating member extending therefrom, (b) a thick, tamper-resistant, substantially planar cylinder lock guard plate adapted to be mounted against one side of the door, the guard plate mounting on one side thereof the cylinder lock and protecting the same, (c) mounting studs integral with the guard plate and extendable through holes in the door when the guard plate is mounted against one side of the door, (d) a drop-bolt assembly positionable on the other side of the door and containing mounting portions on a housing thereof, (e) hardened, stud-protecting sleeves positionable to slip over each mounting stud, each sleeve having one end connectable with the guard plate on one side of the door and an opposite end connectable with the drop-bolt assembly on the other side of the door, (f) means cooperating with the guard plate studs, the sleeves and the mounting portions of the drop-bolt housing for connecting the housing, sleeves and guard plate and for securing the drop-bolt assembly housing to the guard plate studs and thereby integrally connect and secure the drop-bolt assembly housing, the sleeves and the guard plate to provide an integral connected assembly of the guard plate on one side of the door and the drop-bolt assembly on the other side of the door with the cylinder lock assembly sandwiched therebetween and protected inside the door.

2. A lock assembly as in claim 1 further comprising an additional cylinder lock for operating the drop-bolt in the drop-bolt assembly from the inside of the door.

3. A lock assembly as in claim 2 wherein the means for securing the drop-bolt assembly to the mounting studs of the guard plate assembly includes internally-threaded nuts cooperating with the threaded portions of the studs and extending through holes in mounting flanges of the housing for the drop-bolt assembly.

* * * * *